US011103987B2

(12) United States Patent
Dittrich et al.

(10) Patent No.: US 11,103,987 B2
(45) Date of Patent: Aug. 31, 2021

(54) FUEL-OPERATED FIRING DEVICE AND METHOD FOR OPERATING A FIRING DEVICE OF THIS TYPE

(71) Applicant: Hilti Aktiengesellschaft, Schaan (LI)

(72) Inventors: Tilo Dittrich, Feldkirch (AT); Daniel Jung, Munich (DE); Dominik Schmidt, Buchs (CH); Norbert Heeb, Buchs (CH); Peter Bruggmueller, Bludesch (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 73 days.

(21) Appl. No.: 16/062,141

(22) PCT Filed: Dec. 20, 2016

(86) PCT No.: PCT/EP2016/081917
§ 371 (c)(1),
(2) Date: Jun. 14, 2018

(87) PCT Pub. No.: WO2017/108787
PCT Pub. Date: Jun. 29, 2017

(65) Prior Publication Data

US 2018/0370004 A1 Dec. 27, 2018

(30) Foreign Application Priority Data

Dec. 22, 2015 (EP) ..... 15201899

(51) Int. Cl.
*B25C 1/08* (2006.01)

(52) U.S. Cl.
CPC ..... *B25C 1/08* (2013.01)

(58) Field of Classification Search
CPC .... B25C 1/08; B25C 1/14; B25C 1/00; B25C 1/008; F02B 19/1052; F02B 19/1085;
(Continued)

(56) References Cited

U.S. PATENT DOCUMENTS 4,913,331 A * 4/1990 Utsumi ..... B25C 1/08 227/10
6,671,163 B2 12/2003 Shkolnikow et al.
(Continued)

FOREIGN PATENT DOCUMENTS

CN 1436632 A 8/2003
CN 1509847 A 7/2004
(Continued)

OTHER PUBLICATIONS

International Bureau, International Search Report in International Application No. PCT/EP2016/081917, dated Apr. 10, 2017.

*Primary Examiner* — Thomas M Wittenschlaeger
(74) *Attorney, Agent, or Firm* — Leydig Voit & Mayer, Ltd.

(57) ABSTRACT

The invention relates to a fuel-operated firing device for driving securing elements into a substrate, comprising at least one main combustion chamber for a fuel, a driving piston that can be driven out of the main combustion chamber in a firing direction by expandable gases, and a pre-chamber with which an ignition device is associated and in which a pressure acting on the main combustion chamber can build up prior to a fuel-air mixture being ignited in said main combustion chamber. In order to improve the efficacy and/or functionality during the driving in of securing elements, a detection system is associated with the driving piston, said detection system being connected to an electronic feedback control device for control purposes, in order to detect an initial position of the driving piston prior to a firing operation.

15 Claims, 10 Drawing Sheets

(58) Field of Classification Search
CPC ..... F02B 19/00; F02B 19/12; F02B 71/00; F02B 71/04
See application file for complete search history.

(56) References Cited

U.S. PATENT DOCUMENTS

| | | | | |
|---|---|---|---|---|
| 6,679,410 | B2 * | 1/2004 | Wursch | B25C 1/143 227/10 |
| 6,708,860 | B1 | 3/2004 | Thieleke | |
| 6,755,159 | B1 | 6/2004 | Adams et al. | |
| 6,783,045 | B2 * | 8/2004 | Shima | B25C 1/08 227/10 |
| 6,830,017 | B2 * | 12/2004 | Wolf | B25C 1/08 123/46 R |
| 6,948,459 | B1 * | 9/2005 | Laumen | F02B 71/04 123/46 A |
| 7,004,366 | B2 * | 2/2006 | Schiestl | B25C 1/08 123/46 SC |
| 7,048,164 | B2 * | 5/2006 | Favre-Bulle | B25C 1/08 227/10 |
| 7,128,030 | B2 | 10/2006 | Gschwend et al. | |
| 7,980,440 | B2 * | 7/2011 | Hahn | B25C 1/08 123/46 SC |
| 9,527,197 | B2 | 12/2016 | Blessing et al. | |
| 9,782,881 | B2 * | 10/2017 | Wolf | B25C 1/08 |
| 9,782,882 | B2 * | 10/2017 | Wolf | B25C 1/08 |
| 2003/0015088 | A1 * | 1/2003 | Wursch | B25C 1/143 89/1.14 |
| 2003/0044293 | A1 * | 3/2003 | Gray, Jr. | F04B 17/05 417/364 |
| 2004/0079302 | A1 | 4/2004 | Wolf et al. | |
| 2004/0144357 | A1 | 7/2004 | Adams | |
| 2004/0182907 | A1 * | 9/2004 | Dittrich | B25C 1/14 227/10 |
| 2005/0001000 | A1 | 1/2005 | Favre-Bulle et al. | |
| 2008/0011251 | A1 * | 1/2008 | Tanaka | B25C 1/08 123/46 SC |
| 2009/0250499 | A1 | 10/2009 | Hahn et al. | |
| 2011/0068141 | A1 * | 3/2011 | Wolf | B25C 1/08 227/9 |
| 2012/0118932 | A1 * | 5/2012 | Largo | B25C 1/005 227/8 |
| 2013/0037593 | A1 | 2/2013 | Porth et al. | |
| 2016/0144497 | A1 | 5/2016 | Boehm et al. | |
| 2018/0154505 | A1 * | 6/2018 | Sato | B25C 1/008 |

FOREIGN PATENT DOCUMENTS

| | | | |
|---|---|---|---|
| CN | 102284928 | A | 12/2011 |
| DE | 40 10 517 | A1 | 10/1991 |
| DE | 42 43 617 | A1 | 6/1994 |
| DE | 102 32 035 | A1 | 1/2004 |
| DE | 103 27 191 | B3 | 12/2004 |
| EP | 2 106 883 | A1 | 10/2009 |
| EP | 2 826 601 | A1 | 1/2015 |
| JP | S63147012 | A | 6/1988 |
| JP | 2001138264 | A | 5/2001 |
| JP | 2004-074296 | A | 3/2004 |
| JP | 2010-530315 | A | 9/2010 |
| WO | WO 2017/108772 | A1 | 6/2017 |
| WO | WO 2017/108782 | A1 | 6/2017 |

* cited by examiner

FUEL-OPERATED FIRING DEVICE AND METHOD FOR OPERATING A FIRING DEVICE OF THIS TYPE

CROSS-REFERENCE TO RELATED APPLICATIONS

This patent application is the U.S. National Stage of International Patent Application No. PCT/EP2016/081917, filed Dec. 20, 2016, which claims the benefit of European Patent Application No. 15201899.0, filed Dec. 22, 2015, which are each incorporated by reference.

TECHNICAL FIELD

The invention relates to a fuel-operated firing device for driving securing elements into a substrate, comprising at least one main combustion chamber for a fuel, a driving piston which can be driven out of the main combustion chamber in a firing direction by means of expandable gases, and a pre-chamber with which an ignition device is associated and in which a pressure acting on the main combustion chamber can build up prior to a fuel/air mixture being ignited in said main combustion chamber.

BACKGROUND OF THE INVENTION

German unexamined patent application DE 42 43 36 17 A1 discloses a handheld, fuel-operated working device, in particular a firing device for securing elements, having a cylindrical combustion chamber for combustion of an air/fuel mixture, so that a ram can be driven by means of a piston guided through the combustion chamber, wherein a pre-chamber is provided which communicates with an underneath surface of the piston facing away from the combustion chamber and in which an ignition-induced combustion process of an air/fuel mixture can be initiated for the substantially isentropic compression of the air/fuel mixture in the combustion chamber.

BRIEF SUMMARY OF THE INVENTION

The object of the invention is to improve the effectiveness and/or functionality during the driving in of securing elements using a fuel-operated firing device, at least one main combustion chamber for a fuel, a driving piston which can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber.

In a fuel-operated firing device for driving securing elements into a substrate, comprising at least one main combustion chamber for a fuel, a driving piston which can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber, is characterized in that a detection device is associated with the driving piston and is connected to an electronic feedback control device for control purposes, in order to detect an initial position of the driving piston prior to a firing operation. With the aid of the detection device a displacement of the driving piston can be detected in a simple manner if the driving piston is not located precisely in a defined initial position. The connection for control purposes between the detection device and the electronic feedback control device enables the transmission of sensor signals and/or control signals. The connection for control purposes can optionally be wireless. With the aid of the electronic feedback control device during operation of the fuel-operated firing device the injection quantity is adjusted according to a current position or piston position or piston displacement of the driving piston.

A preferred exemplary embodiment of the fuel-operated firing device is characterized in that the detection device associated with the driving piston comprises a piston end position sensor. The piston end position sensor can be arranged in the region of a firing end of the firing device, that is to say on a so-called tool tip. However, the piston end position sensor canals be arranged in the region of a magnet device which constitutes a magnetic retainer for the driving piston. The detection device can also comprise a piston travel sensor on the firing end or in the tool tip of the firing device.

A further preferred exemplary embodiment of the fuel-operated firing device is characterized in that the piston end position sensor comprises a proximity sensor, a contact switch and/or an inductive switch. Depending upon the design, an already existing piston end position sensor in the firing device can also be used, together with the aid of the electronic feedback control device, in order to adjust the metered quantity during operation of the firing device.

A further preferred exemplary embodiment of the fuel-operated firing device is characterized in that the detection device associated with the driving piston comprises a piston position sensor. The piston position sensor offers the advantage that it can detect the current position of the driving piston regardless of whether the driving piston is located in the vicinity of one of its end positions or far away from it. In this case the piston position sensor does not necessarily have to be able to detect the entire piston displacement path. In some circumstances it is sufficient, when critical positions of the piston are detected.

A further preferred exemplary embodiment of the fuel-operated firing device is characterized in that the piston position sensor comprises a Hall effect sensor with which grooves on the driving piston are associated. The grooves are preferably provided on a piston rod of the driving piston which extends from a piston head or piston plate of the driving piston. The Hall effect sensor is preferably arranged in the region of the firing end or in the tool tip of the firing end.

A further preferred exemplary embodiment of the fuel-operated firing device is characterized in that the control device comprises a control unit by means of which the firing energy is determined from a differential pressure between the main combustion chamber and an ambient pressure. The pre-chamber comprises at least one through opening which can be closed by the control unit. The pre-chamber can be connected to the environment by means of the opened through opening. Furthermore, the control unit is connected for control pressure purposes to the main combustion chamber. During operation of the firing device the control unit is controlled by the main combustion chamber pressure. If the pressure in the main combustion chamber reaches a certain pressure level, then the at least one through opening of the pre-chamber is automatically opened.

A further preferred exemplary embodiment of the fuel-operated firing device is characterized in that the electronic feedback control device is connected for control purposes to a sensor device for detection of environmental conditions of the firing device. The sensor device comprises, for example, a temperature sensor, a pressure sensor, an acceleration sensor, a speed sensor and/or a sensor for detecting a height at which the bolt firing device is currently located.

In a method for operating a previously described fuel-operated firing device, the object set out above is alternatively or additionally achieved in that a quantity of fuel gas for injection into the pre-chamber and/or into the main combustion chamber is controlled as a function of the initial position of the driving piston. If a piston displacement of the driving piston detected with the aid of the detection device is small enough, that is to say if the piston does not exceed a predetermined limiting value, in order to operate the firing device in the usual way, then injection into the pre-chamber and into the main combustion chamber takes place quite normally. If a piston displacement of the driving piston detected by the detection device is small enough to operate the firing device in the usual way, but exceeds a critical limiting value, then the quantity for injection into at least one of the chambers, that is to say the pre-chamber and/or the main combustion chamber, is adjusted.

A further preferred exemplary embodiment of the method is characterized in that fuel gas is only injected into the main combustion chamber and ignited if a piston displacement exceeds a predetermined limiting value. If with the aid of the detection device it is detected that a piston displacement of the driving piston is too great, then an appropriate quantity of gas is injected only into the main combustion chamber. Then injection into the pre-chamber does not take place. After injection has taken place, the fuel/air mixture located in the main combustion chamber is ignited in order to carry out a firing operation with low energy. The firing operation with low energy advantageously serves to return the driving piston again into a defined initial position, for example by means of thermal piston return, at which a negative pressure which draws the piston back is produced by the cooling of the fuel gas after the firing operation. After this a normal firing operation can be carried out.

An alternative exemplary embodiment of the method is characterized in that fuel gas is only injected into the pre-chamber and ignited if a piston displacement exceeds a predetermined limiting value. If with the aid of the detection device it is detected that a piston displacement of the driving piston is too great, then an appropriate quantity of gas is injected only into the pre-chamber. Then injection into the main combustion chamber does not take place. After injection has taken place, the fuel/air mixture located in the pre-chamber is ignited in order to return the driving piston again into a defined initial position. After this a normal firing operation can be carried out.

An alternative exemplary embodiment of the method is characterized in that fuel gas is injected into the pre-chamber and into the main combustion chamber and is ignited with a time difference, wherein the time difference is calculated on the basis of sensor signals. After this a normal firing operation can be carried out.

Furthermore, the invention also relates to a computer program product with a program code for carrying out a previously described method, in particular if the program is executed in the controller of the setting device.

BRIEF DESCRIPTION OF THE SEVERAL VIEWS OF THE DRAWING(S)

Further advantages, features and details of the invention are apparent from the following description in which various embodiments of the invention are described in detail with reference to the drawings. In the drawings.

DETAILED DESCRIPTION OF THE INVENTION

Figure 1:
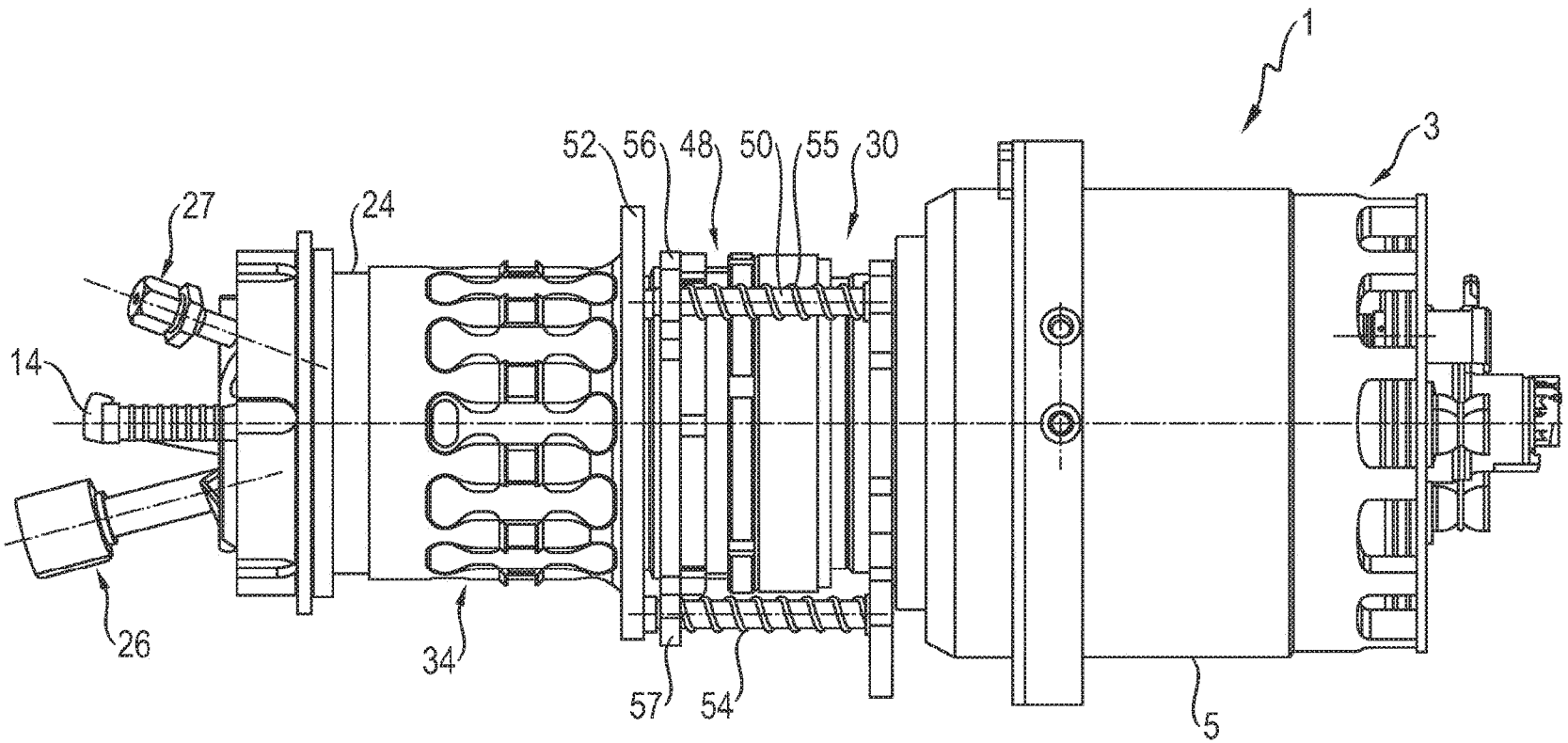
FIG. 1 shows a plan view of a fuel-operated bolt firing device in an unpressed initial state during scavenging of a main combustion chamber.

FIGS. 1 to 7 show a highly simplified longitudinal section of a firing device 1 in different operating states and views. The firing device 1 shown in FIGS. 1 to 7 can be operated with a fuel gas or with a vaporizable liquid fuel. The firing device 1 comprises a housing 3 with a main cylinder 5 which delimits a main combustion chamber 6. The main combustion chamber 6 can be supplied with gas and/or air by means of an inlet device 8. Furthermore, an ignition device 9 is associated with the main combustion chamber 6.

Figure 6:
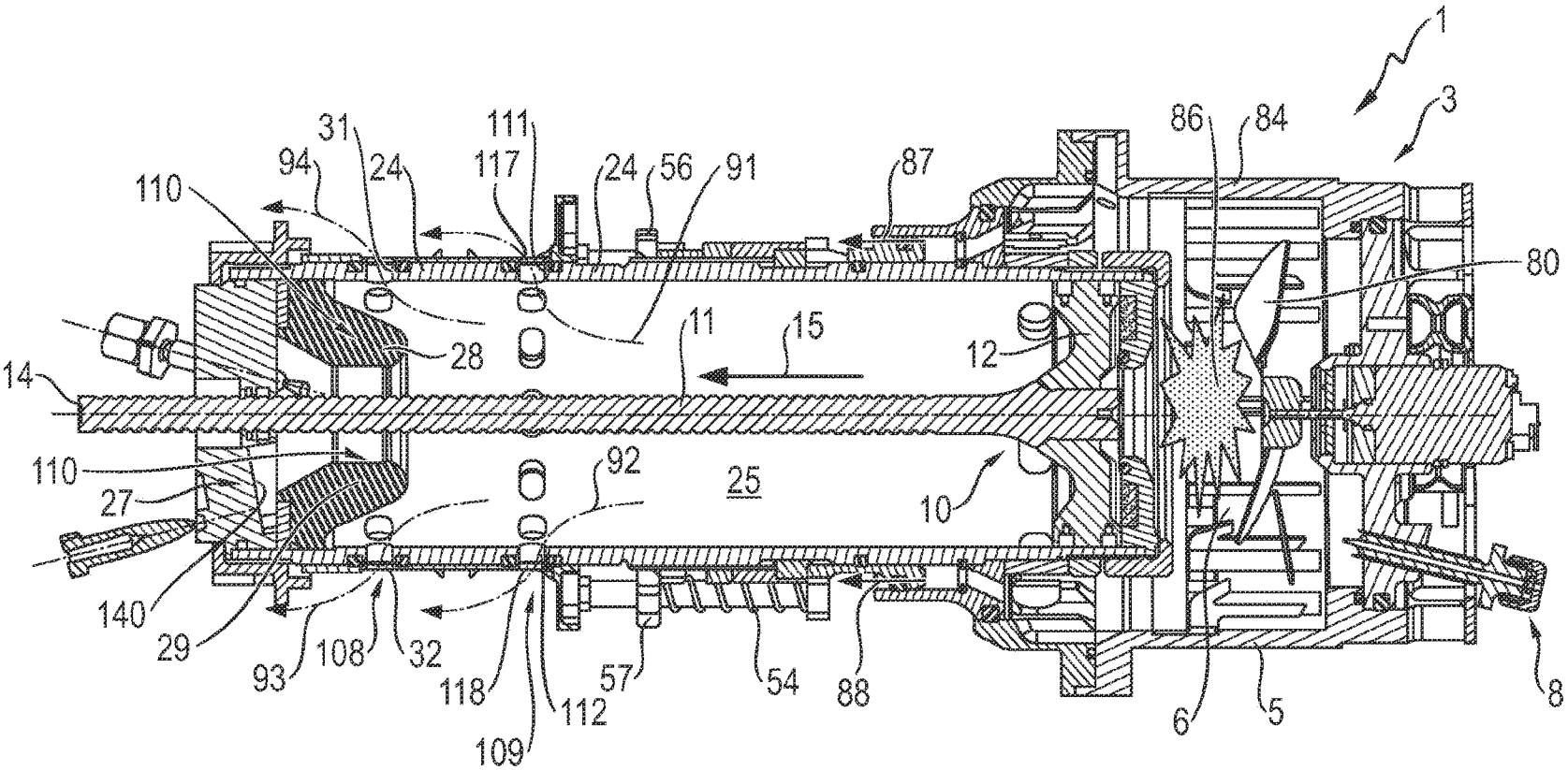
FIG. 6 shows a longitudinal section of the bolt firing device from FIGS. 1 to 5 during ignition in the main combustion chamber with opened venting connections.
Figure 7:
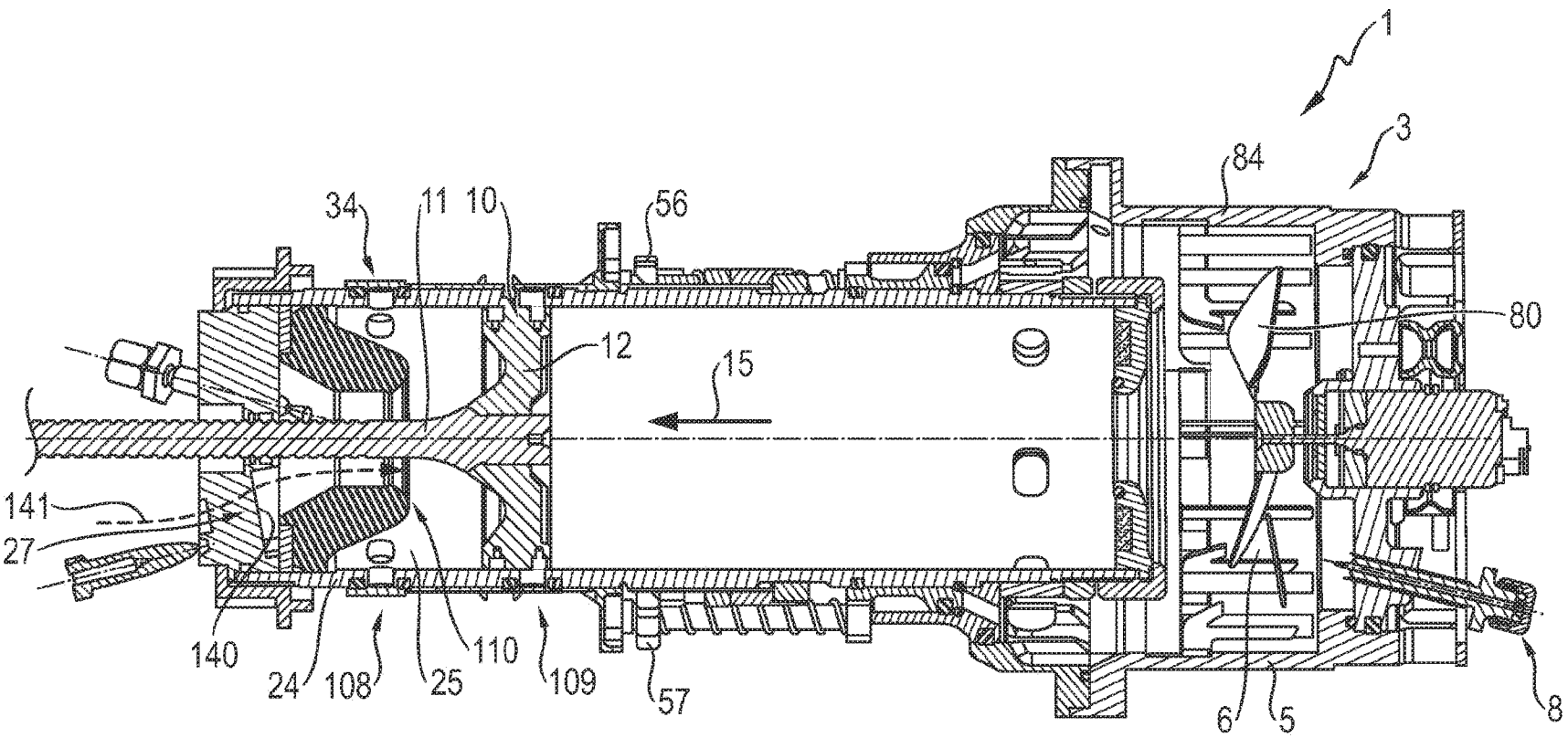
FIG. 7 shows a longitudinal section of the bolt firing device from FIGS. 1 to 6 during thermal return of a driving piston with closed venting connections.
Figure 9:
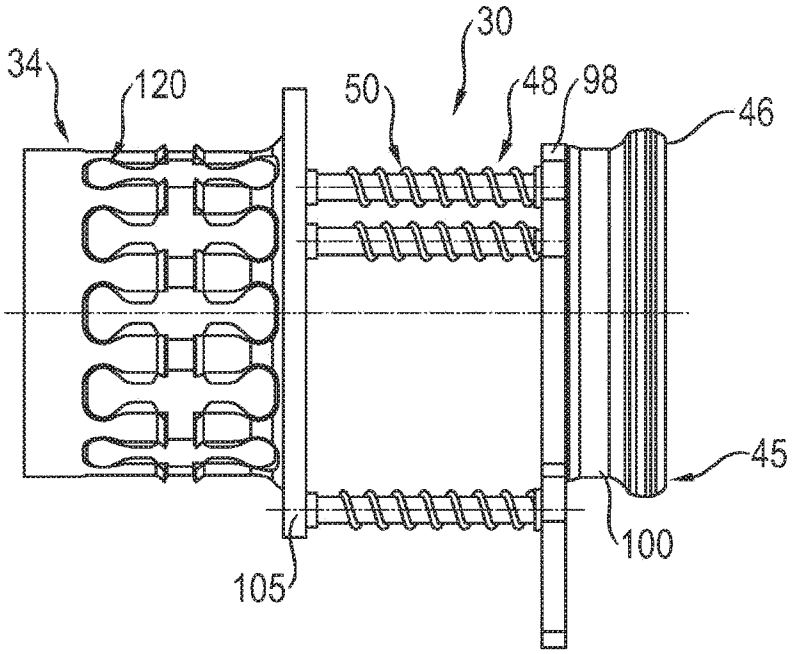
FIG. 9 shows a plan view of the control device from FIG. 8.
Figure 8:
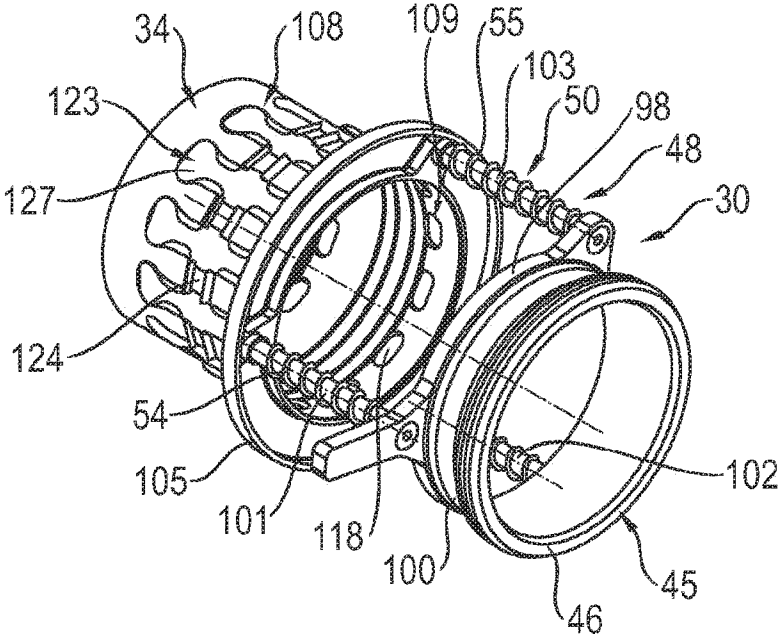
FIG. 8 shows a perspective representation of a control device from FIGS. 1 to 6.

In FIGS. 1 to 7 a driving piston 10 is guided movably back and forth in the housing 3 of the firing device 1. The driving piston 10 comprises a piston rod 11 which extends from a piston head 12. A firing end 14 of the piston rod 11 remote from the piston head or piston plate 12 is arranged in a bolt guide which serves for operating securing elements which are also designated as bolts. In FIG. 7 the firing end 14 of the piston rod 11 of the driving piston 10 is shown truncated.

The bolt guide with the piston rod 11 of the driving piston 10 arranged therein is also designated as a firing unit. By means of the firing unit a securing element, such as a nail, bolt or the like, can be driven into a substrate (not shown). Before the firing of a securing element, the firing device 1 with its bolt guide is pressed onto the substrate and triggered. A switch (not shown) which is also designated as a trigger switch serves, for example, for triggering a firing operation. The switch is provided, for example, on a handle (likewise not shown) of the firing device 1.

A firing device is indicated by an arrow 15 in FIGS. 1 to 7. During the firing of a securing element, the driving piston 10 with the piston rod 11 is greatly accelerated in the firing direction 15 in order to drive the securing element into the substrate. During the firing operation, the driving piston 10 is moved out of its starting position shown in FIG. 1, which corresponds to an upper or rear dead center, into an end position which corresponds to a lower or front dead center.

A movement of the driving piston 10 towards the right in FIGS. 1 to 7 is delimited by a piston stop 16 fixed to the housing. The upper dead center of the driving piston 10 is defined by the piston stop 16. The piston stop 16 can be combined with a magnet device 17. The magnet device 17 serves, for example, to hold the driving piston 10 with a predetermined holding force in its starting position shown in FIG. 1.

A movement of the driving piston 10 towards the left is delimited by stop and/or damping elements 28, 29. The stop and/or damping elements 28 constitute a buffer 110.

The piston head 12 comprises a first piston surface 21 which faces the main combustion chamber 6. A second piston surface 22, which faces away from the main combustion chamber 6, delimits a pre-chamber 25 in a pre-chamber cylinder 24.

The pre-chamber 25 constitutes a pre-combustion chamber with which an ignition device 26 and an inlet device 27 are associated. Furthermore, the stop and/or damping elements 28, 29 are arranged in the pre-chamber 25. A gas/air fuel mixture, which is ignited with the aid of the ignition device 26 in the pre-chamber 25, is supplied to the pre-chamber or pre-combustion chamber 25 by means of the inlet device 27.

The pre-chamber cylinder 24 comprises through openings 31, 32 which, for example, enable the exhaust gases to exit the pre-chamber 25. The through openings 31, 32 can be closed as required by a control device 30. The control device 30 comprises a control sleeve 34 which has through openings 37, 38.

Figure 11:
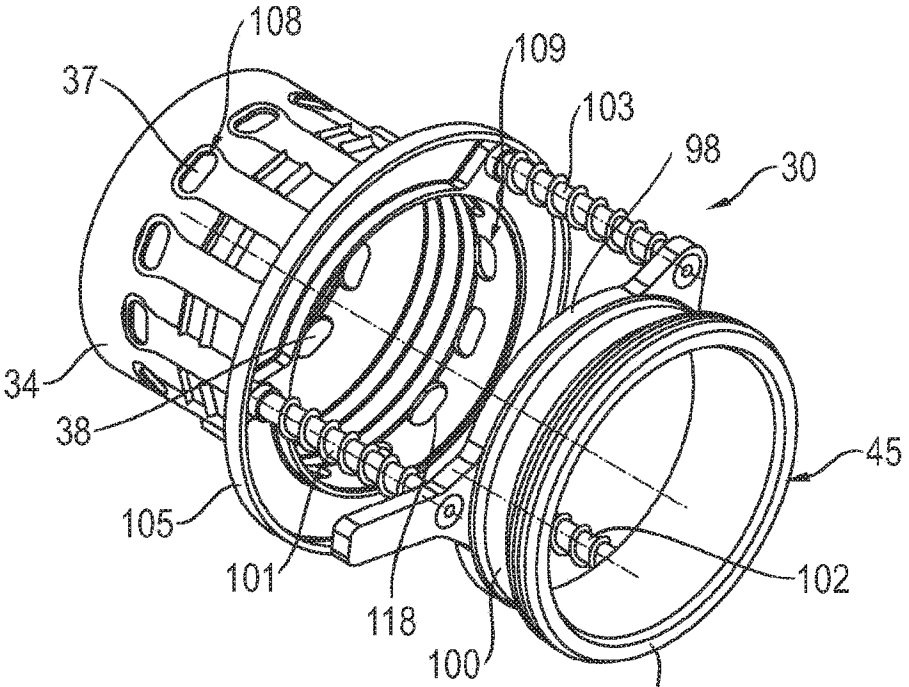
FIG. 11 shows a perspective representation of the control device from FIGS. 8 and 9 without the non-return valve device which is shown alone in FIG. 10.

If the through openings 37, 38 of the control sleeve 34 are made to overlap the through opening 31, 32, then the through openings 31, 32 are opened, as can be seen in FIG. 6. In FIGS. 1 to 5 and 7 the through openings 31, 32 are closed by the control sleeve 34. The control sleeve 34 has substantially the configuration of a straight circular cylindrical shell and is illustrated in detail in FIG. 11.

Overflow openings 41, 42 are provided between the pre-chamber 25 and the main combustion chamber 6. A valve device 43, 44 is associated with each of the overflow openings 41, 42. The valve devices 43, 44 are, for example, valve flaps which enable a passage of an ignited air/fuel mixture from the pre-chamber 25 into the main combustion chamber 6.

The control device 30 comprises a control pressure surface 45, which is connected to the main combustion chamber 6 for control pressure purposes. The control pressure surface 45 is configured as an annular surface 46 which faces the main combustion chamber 6 radially outside the pre-chamber cylinder 24. The control pressure surface 45 is coupled mechanically to the control sleeve 34 by means of a coupling element 48.

The coupling element 48 is designed as a slider 50 which, in FIGS. 1 to 7, is guided movably back and forth in the horizontal direction on the pre-chamber cylinder 24. The control pressure surface 45 designed as an annular surface 46 is provided on a right-hand end 51 of the slider 50 in FIGS. 1 to 7. The control sleeve 34 is fastened to a left-hand end 52 of the slider 50 in FIGS. 1 to 7.

Furthermore, the control device 30 comprises spring devices 54, 55 which are designed, for example, as helical compression springs. Housing-mounted stops 56, 57 are in each case associated with the left-hand ends of the spring devices 54, 55 in FIGS. 1 to 7. The housing-mounted stops 56, 57 are provided on the pre-chamber cylinder 24.

The spring devices 54, 55 are clamped between the housing-mounted stops 56, 57 and the right-hand end 51 of the slider 50 having the control pressure surface 45. Thus, the slider 50 is supported on the housing-mounted stops 56, 57 by means of the spring devices 54, 55.

Figure 2:
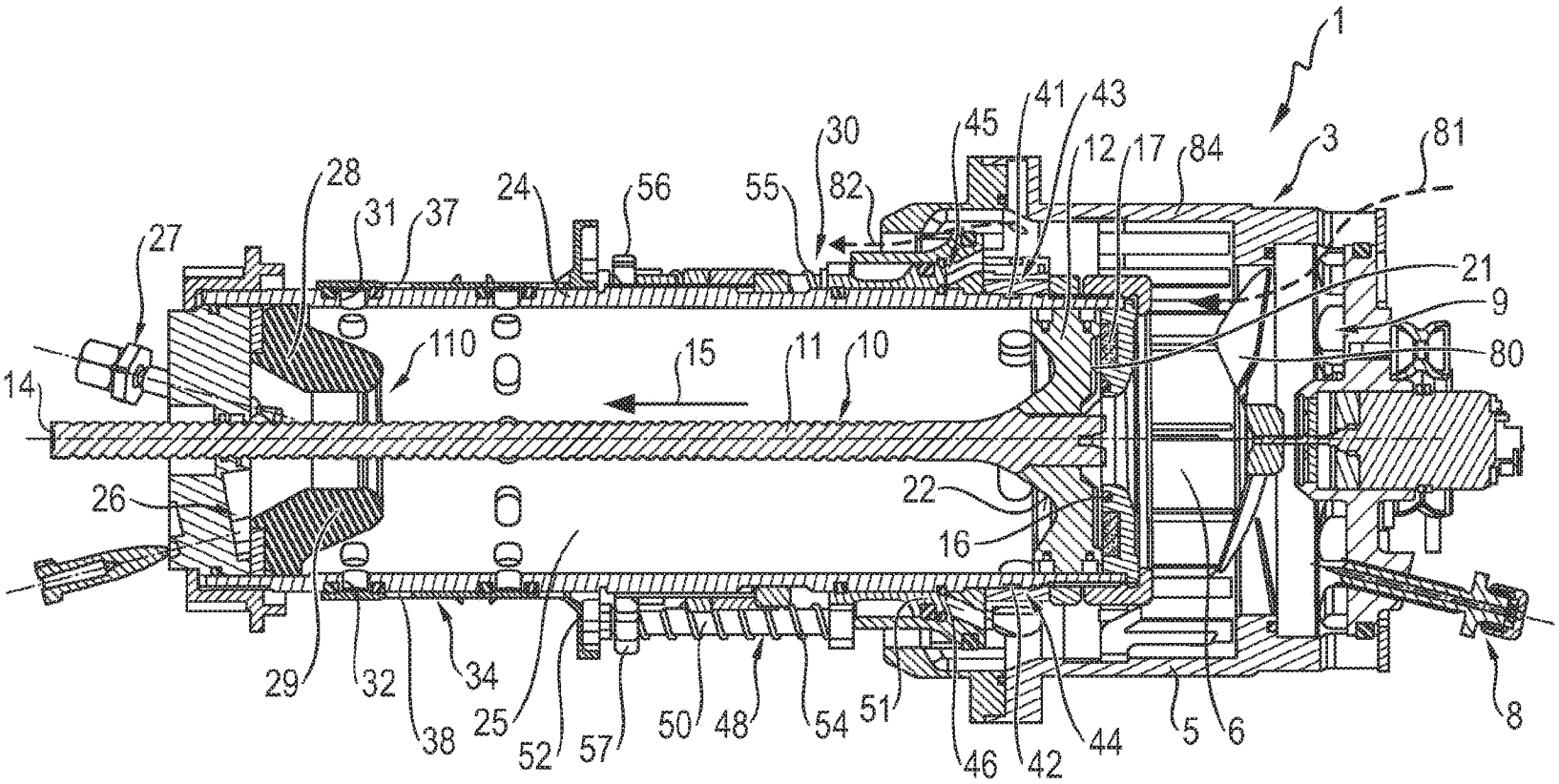
FIG. 2 shows a longitudinal section of the bolt firing device from FIG. 1.
Figure 3:
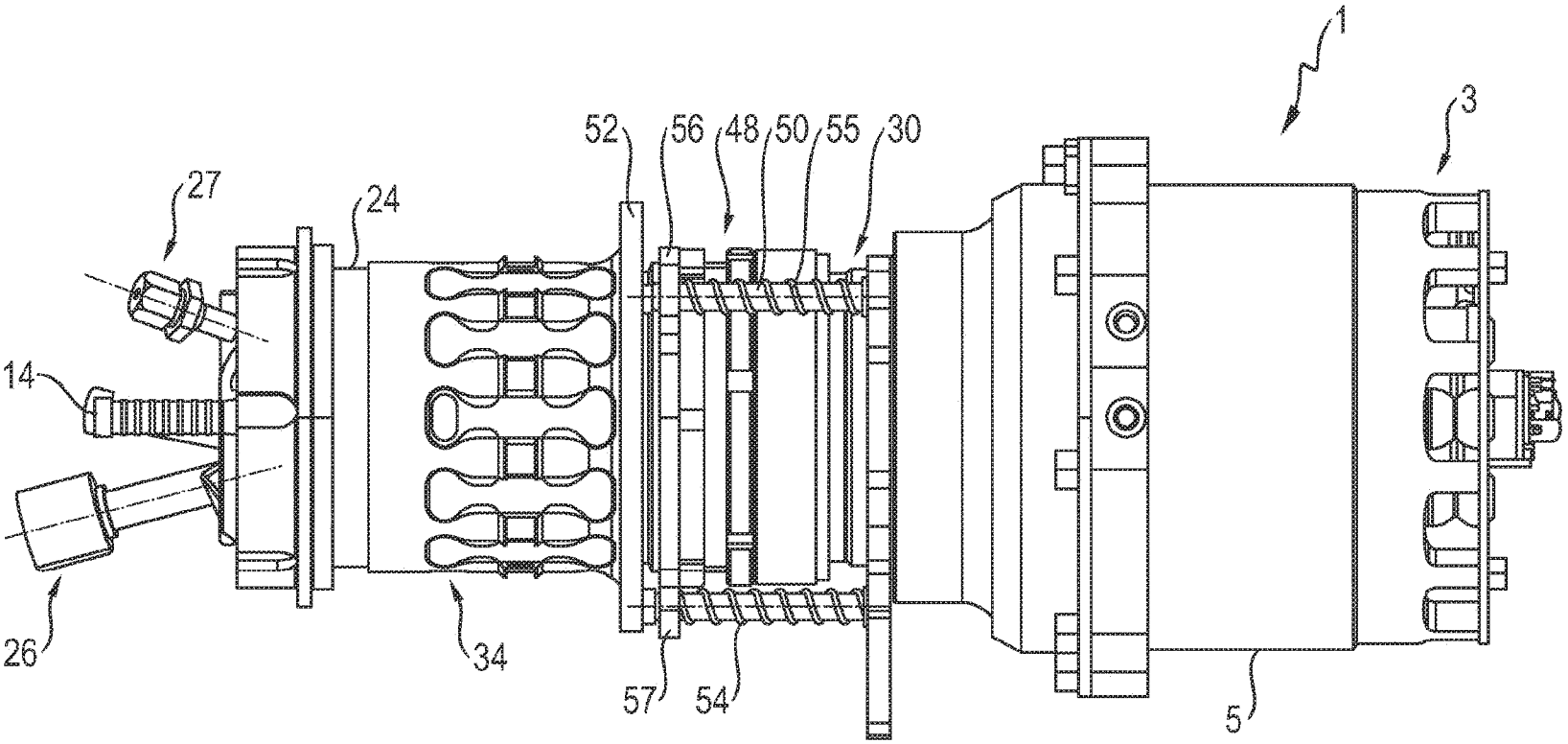
FIG. 3 shows a plan view of the bolt firing device from FIGS. 1 and 2 in a pressed state with a closed main combustion chamber.
Figure 4:
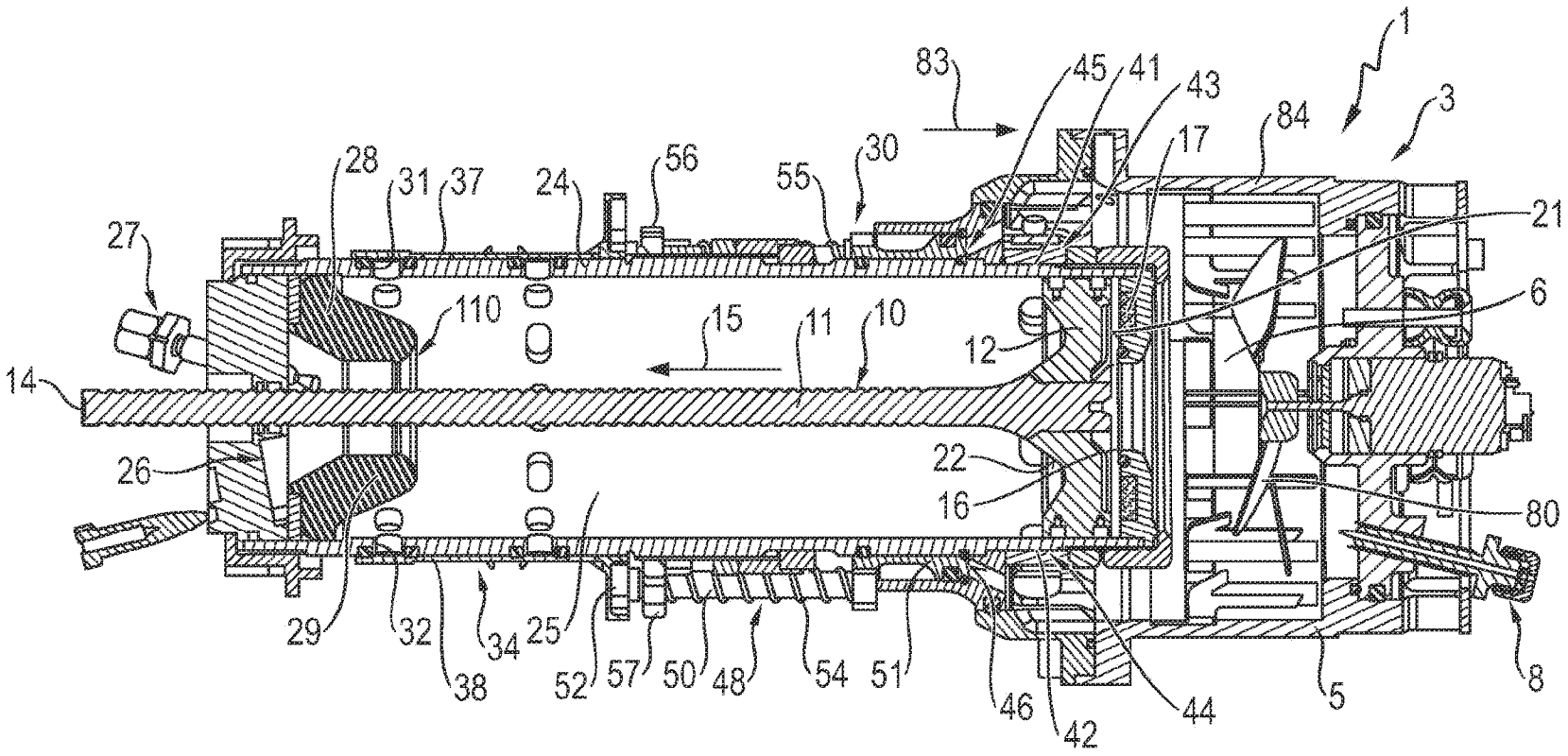
FIG. 4 shows a longitudinal section of the bolt firing device from FIG. 3.
Figure 5:
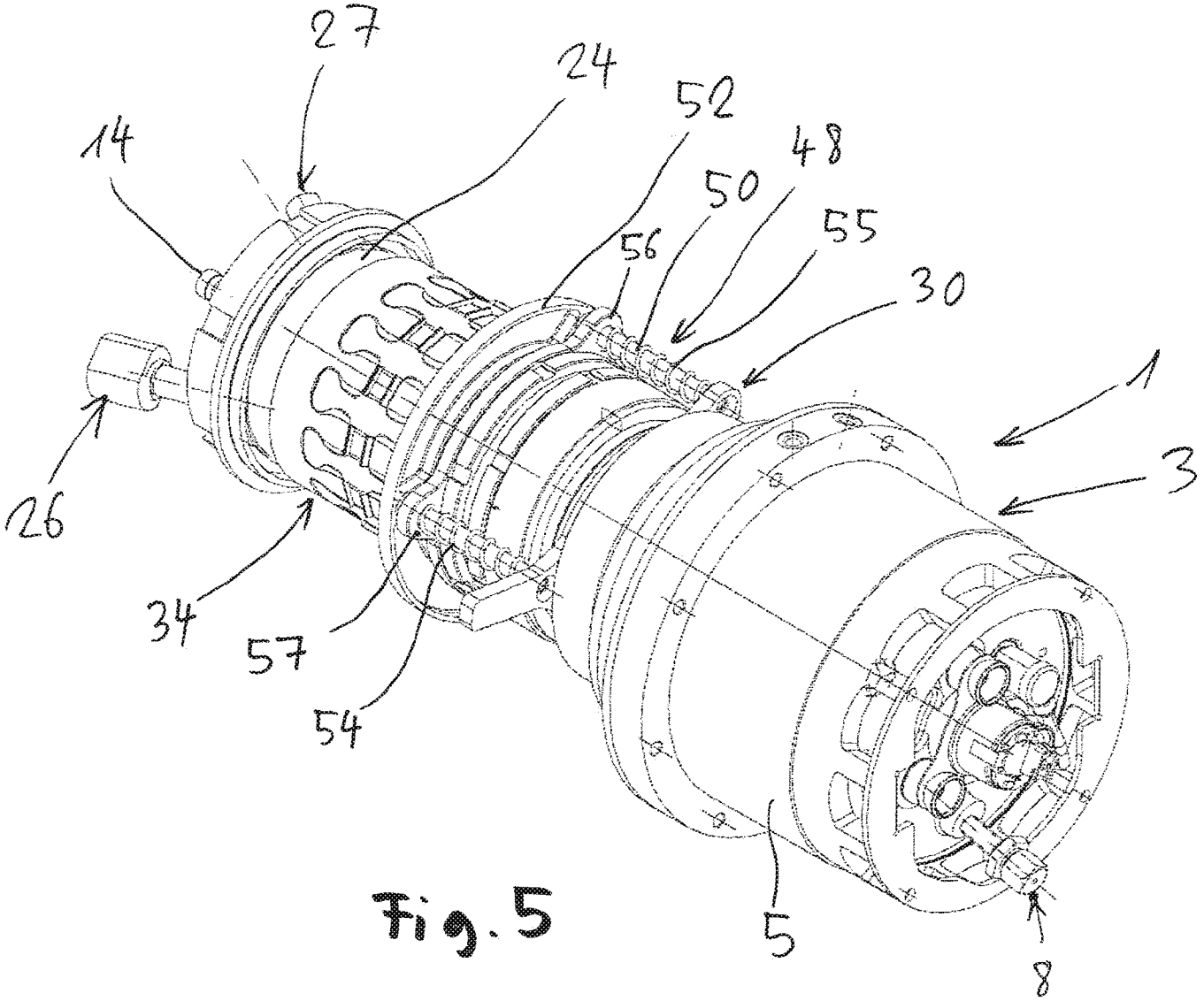
FIG. 5 shows a perspective representation of the bolt firing device from FIGS. 3 and 4.

In FIGS. 1 and 2 the bolt firing device 1 is shown in an unpressed state. "Unpressed state" means that the firing end 14 of the driving piston 10 is not acted upon with a pressing force by a bolt or a securing element which should be driven into a substrate. When pressed, the bolt firing device 1 is pressed with a tool tip of the bolt firing device 1 against the substrate.

The main combustion chamber 6 is delimited by a combustion chamber sleeve 84 which can be moved to a limited extent in the axial direction in order to enable scavenging of the main combustion chamber 6. A fan 80 is arranged in the main combustion chamber 6.

In FIG. 2 the position of the combustion chamber sleeve 84 is such that the fan 80 generates an air stream 81, 82, indicated by arrows, from the rear face of the device, that is to say the right-hand face in FIG. 2, through the main combustion chamber 6 into the environment. After a firing operation exhaust gases are transported out of the main combustion chamber 6 by the air stream 81, 82. Furthermore, the air stream 81, 82 ensures cooling of the main combustion chamber 6.

In FIGS. 3 to 6 the bolt firing device 1 is shown in a pressed state. In the pressed state the firing end 14, which is also designated as a tool tip, is pressed against a securing element. Due to the pressing movement the combustion chamber sleeve 84 is moved rearwards, that is to say towards the right in FIG. 4, as indicated by an arrow 83 in FIG. 4. The main combustion chamber 6 is closed off from the environment towards the rear by the movement 83 of the combustion chamber sleeve 84.

As described below, fuel gas is injected into the pre-chamber 25 by means of the inlet device 27 and into the main combustion chamber 6 by means of the inlet device 8. During injection of the fuel gas into the pre-chamber 25 and into the main combustion chamber 6 the fan 80 rotates in the main combustion chamber 6.

The ignition of the gas mixture is initiated by the ignition device 26 which is associated with the pre-chamber 25 and located in the vicinity of the buffer 110. After the ignition of the gas mixture in the pre-chamber 25, a laminar flame front propagates, travelling from the side of the buffer 110 in the direction of the main combustion chamber 6, that is to say towards the right in FIG. 4. In this case the propagating laminar flame front pushes uncombusted air/fuel mixture ahead of it at high pressure into the main combustion chamber 6.

The overflow from the pre-chamber 25 into the main combustion chamber 6 takes place by means of the overflow openings 41, 42 with the valve devices 43, 44 open. The valve devices 43, 44 are, for example, designed as non-return valves which expose the overflow openings 41, 42, which are also designated as ignition openings, during propagation of the laminar flame front.

When the flame front has reached the non-return valves of the valve devices 43, 44, the flame can pass via the non-return valves into the main combustion chamber 6 for ignition, so that the main chamber combustion is initiated in the main combustion chamber 6. In FIG. 6 is the main chamber ignition in the main combustion chamber 6 is indicated by a symbol 86.

During the main chamber ignition 86 the pressure in the main combustion chamber 6 rises and the control sleeve 34 is pushed forwards, that is to say towards the left in FIG. 6 as indicated by arrows 87, 88, against the force of the spring devices 54, 55 which are supported on the housing-mounted stops 56, 57. Two pressure relief connections 108, 109 of the pre-chamber 25 are opened by the movement 87, 88 of the control sleeve 34 forwards.

The pre-chamber pressure escaping from the pre-chamber 25 by means of the opened venting connections 108, 109 is indicated by arrows 91 to 94 in FIG. 6. The pressure relief connections 108, 109 are also designated as exhaust outlets. The pre-chamber pressure can escape by means of the pressure relief connections or exhaust outlets 108, 109 at the main chamber ignition 86. At the main chamber ignition 86 the driving piston 10 moves at high speed and carries out a firing.

In FIG. 7 the bolt firing device 1 is shown in longitudinal section during thermal return of the driving piston 10. After the driving piston 10 has reached the lower or front piston reversal point on the buffer 110, a main chamber residual pressure is discharged by means of the pressure relief connection 109. The consequence of this is that the main combustion chamber pressure in the main combustion chamber 6 drops to ambient pressure and the control sleeve 34 closes the exhaust outlets or pressure relief connections 108, 109 again in a pressure-controlled manner.

After the firing a negative pressure is produced in the main combustion chamber 6 by cooling of the bolt firing device 1. This negative pressure in the main combustion chamber 6 leads to the driving piston 10 being retracted or drawn back into its starting position. In this case fresh air is sucked or drawn into the pre-chamber 25 of the bolt firing device 1 through a pre-chamber inlet 140 on the left-hand end of the pre-chamber cylinder 24 in FIG. 7. The drawing in of the fresh air is indicated by an arrow 141 in FIG. 7.

A non-return valve on one side is advantageously associated with the pre-chamber inlet 140. The non-return valve comprises, for example, a relatively large spring lamella, which enables fresh air to be drawn into the pre-chamber 25, but in the reverse direction it prevents unwanted outflow of pressurized fuel/air mixture out of the pre-chamber 25 into the environment.

When the bolt firing device 1 with the firing end 14, which is shown truncated in FIG. 7, is lifted off from the substrate, the combustion chamber sleeve 84 is moved again so that the main combustion chamber 6 can be scavenged with ambient air, as indicated by the arrows 81 and 82 in FIG. 2. Subsequently a new firing cycle can be started.

The control device 30 is illustrated alone in different views in FIGS. 8 to 11. The control device 30 comprises the control sleeve 34 which is connected by means of the coupling element 48 to a coupling sleeve 100. The control pressure surface 45 designed as an annular surface 46 is provided on a free end of the coupling sleeve 100, that is to say the right-hand end of the coupling sleeve 100 FIG. 9.

The coupling 100 is fixedly connected to a connecting flange 105 by means of slider rods 101, 102, 103 which partially constitute the slider 50. The connecting flange 105 connects the control sleeve 34 to the slider rods 101 to 103. On the other hand, the slider rods 101 to 103 are connected by means of a connecting flange 98 to the coupling sleeve 100.

A spring device 54, 55 designed as a compression spring is associated with each slider rod 101 to 103. In the installed state of the control device 30 the spring devices 54, 55 are clamped between the connecting flange 98 and the housing-mounted stops 56, 57 on the pre-chamber cylinder 24.

The control sleeve 34 serves to expose the through openings 31, 32; 117, 118 in the pre-chamber cylinder 24 as required, as indicated in FIG. 6 by the arrows 91 to 94. For this purpose the control sleeve 34 has the through openings 37, 38; 117, 118 which are made to overlap the through openings 31, 32; 111, 112 in the pre-chamber cylinder 24 for opening the venting connections 108, 109.

Figure 10:
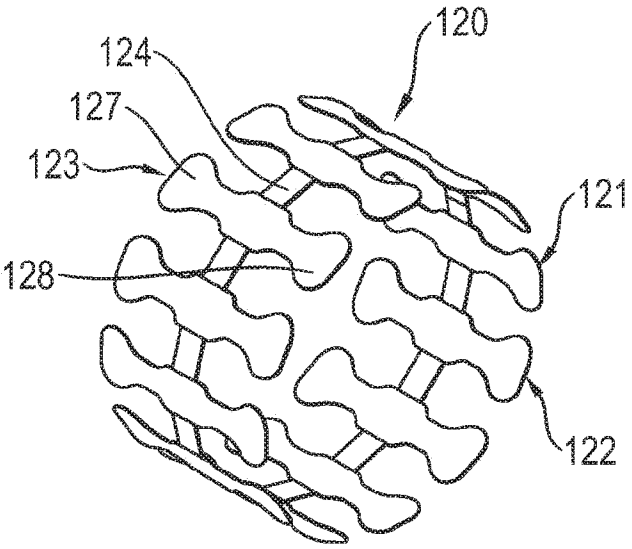
FIG. 10 shows a perspective representation of a non-return valve device which is integrated into the control device of FIGS. 8 and 9.

In FIG. 10 it can be seen that the non-return valve device 120 comprises valve elements 121 to 123 which are connected to one another by a connecting ring member 124. Each of the valve elements 121 to 123 comprises two closing elements 127, 128, which are associated with through openings 37; 118 of the two pressure relief connections 108; 109.

The valve elements 121 to 123 with the closing elements 127, 128 are formed integrally from spring steel. The production of the valve elements 121 to 123 with the closing elements 127, 128 takes place, for example, by laser beam cutting. The connecting ring member 124 can likewise be produced by laser beam cutting from a spring steel material.

Figure 12:
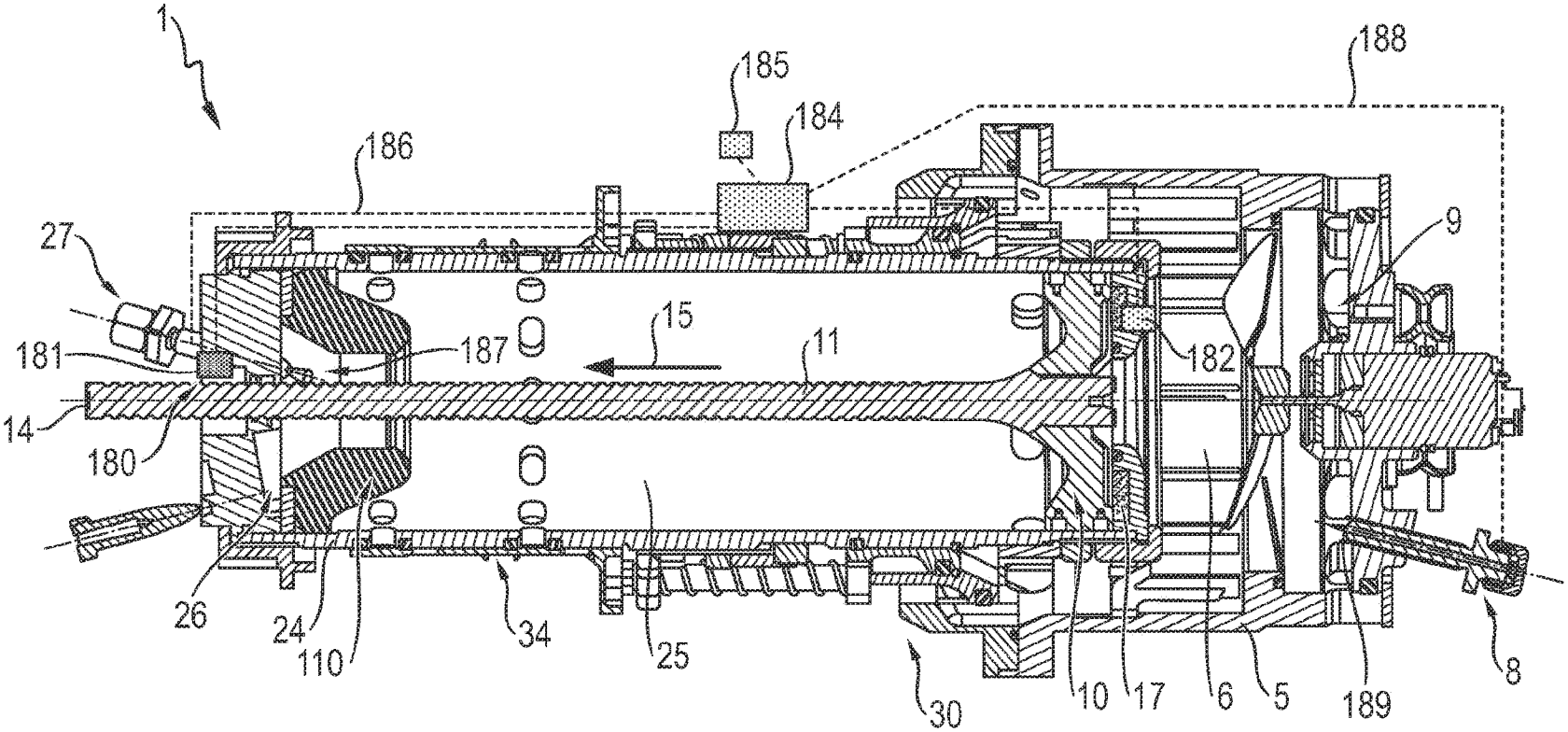
FIG. 12 shows the same representation as in FIG. 2 with a detection device associated with the driving piston for adjusting metered quantities.

The bolt firing device 1 illustrated in FIG. 12 is additionally equipped with a detection unit 180 which serves to detect a position, an initial position or a piston displacement of the driving piston 10 before a firing operation. The detection device 180 is only indicated by a rectangle and is arranged, for example, between an inner housing and an outer housing of the firing device 1.

The detection device 180 comprises piston end position sensors 181, 182 and is connected for control purposes to an electronic feedback control device 184. The connections for control purposes are indicated by broken lines.

The piston end position sensor 181 is arranged on an end of the pre-chamber cylinder 24 remote from the main combustion chamber 6. The piston end position sensor 182 is combined with a magnet device 17 which constitutes a magnetic retainer for the driving piston 10 in its initial position shown in FIG. 12.

Furthermore, the firing device 1 is equipped with a sensor arrangement 185. The sensor arrangement 185 serves for detecting environmental influences such as, for example, an ambient temperature or an ambient pressure. The sensor arrangement 185 is likewise connected for control purposes to the electronic feedback control device 184.

The electronic feedback control device 184 is connected for control purposes to an injection device 187 by means of a control line 186. The injection device 187 is part of the inlet device 27, by means of which fuel gas is injected into the pre-chamber 25. Furthermore, the electronic feedback control device 184 is connected for control purposes to an injection device 189 by means of a control line 188. The injection device 189 is part of the inlet device 8, by means of which fuel gas is injected into the main combustion chamber 6.

The piston end position sensor 182 is designed, for example, as a proximity sensor or contact switch. With the piston end position sensor 182 it can be detected in a simple manner whether the driving piston 10 is located in its defined initial position which is illustrated in FIG. 12.

The piston end position sensor 181 can also be designed advantageously as a piston position sensor or as a sensor for detecting the piston travel of the driving piston 10. As a piston position sensor, the sensor 181 can detect whether the driving piston 10 has more or less than a defined displacement. Thus with the sensor 181 it can be detected, for example, whether the driving piston 10 has a displacement of more or less than, for example, thirty percent.

If the sensor 181 is designed as a sensor detecting the piston travel, then the initial position of the piston can be detected by the sensor 181. For this purpose the sensor 181 is designed, for example, as a Hall effect sensor and for sensor purposes interacts with grooves which are provided on or in the piston rod 11 of the driving piston 10.

With the aid of the electronic feedback control device 184 it is possible to distinguish the extent of a piston displacement detected by the detection device 180. If the piston displacement is small enough in order to operate the firing device 1 in the usual way, then an injection into both chambers 25, 6 takes place and the ignition takes place initially only in the pre-chamber 25. The ignition in the pre-chamber 25 is initiated by the ignition device 26 which is associated with the pre-chamber 25.

If a piston displacement detected by the detection device 180 is small enough to operate the firing device 1 in the usual way, but exceeds a certain first limiting value, then the quantity for injection into at least one of the chambers 25, 6 is adjusted. For example, in the event of a rather small piston displacement, wherein the driving piston 10 has remained at a certain distance from the rear piston stop, somewhat more fuel gas can be injected into the main combustion chamber 6 and correspondingly somewhat less gas is injected into the pre-chamber 25. Due to this measure the fuel/air mixture in both chambers 25, 6 remains approximately stoichiometric and can be readily ignited.

If the piston displacement detected by the detection device 180 is too great, that is to say it exceeds a predetermined second limiting value which is greater than the first limiting value, then the firing device 1 is only ignited in the main combustion chamber 6. An appropriate quantity of fuel gas is injected into the main combustion chamber 6 beforehand. If the piston displacement is too great injection does not take place into the pre-chamber 25.

Following the injection into the main combustion chamber 6 only the main combustion chamber 6 is ignited, and by means of the ignition device 9 associated with the main combustion chamber 6. Then the firing device 1 is operated with lower energy, but after the firing operation the driving piston 10 returns with lower energy into its defined initial position which is illustrated in FIG. 12. Then a normal firing cycle can take place with an injection into both chambers 25, 6.

The firing device 1 illustrated in FIG. 12 offers the following advantages over the known prior art: higher reliability, because the firing device illustrated in FIG. 12 ensures that the pre-chamber combustion and the main chamber combustion is reliable due to the stoichiometric mixture preparation. There are no ignition failures or weak combustion processes, which ultimately lead to low energy. With the firing device 1 in FIG. 12 it is ensured that the device energy remains constant due to the regulation of the injection quantity. Naturally, this does not apply for a case where for elimination of the piston displacement ignition only takes place in the main combustion chamber 6.

Furthermore, the firing device 1 illustrated in FIG. 12 offers the advantage that a greater piston displacement is automatically detected. Then a firing operation with lower energy and with only a main chamber ignition can be initiated automatically. As a result the driving piston 10 comes into its defined initial position and the firing device 1 again functions normally in the next firing cycle.

The invention claimed is:

1. A method for operating a fuel-operated firing device for driving securing elements into a substrate, the device comprising at least one main combustion chamber for a fuel; a driving piston which can be driven out of the at least one main combustion chamber from a rear dead center position in a firing direction by expandable gases; a pre-chamber with which an ignition device is associated and in which a pressure acting on the at least one main combustion chamber can build up prior to a fuel/air mixture being ignited in the at least one main combustion chamber; and, a detection device associated with the driving piston; connected to an electronic feedback control device for control purposes, in order to detect a piston displacement between an actual initial position of the driving piston prior to a firing operation and the rear dead center position, the method comprising controlling a quantity of fuel gas for injection into the pre-chamber and/or into the at least one main combustion chamber as a function of the piston displacement, wherein, if the piston displacement does not exceed a first limiting value, then a first amount of fuel gas is injected into the at least one main combustion chamber, and, if the piston displacement exceeds the first limiting value, then more than the first amount of fuel gas is injected into the at least one main combustion chamber.

2. The method according to claim 1, comprising only injecting fuel gas into the pre-chamber and into the at least one main combustion chamber and igniting the fuel gas with a time difference, wherein the time difference is calculated on the basis of sensor signals.

3. The method according to claim 1, wherein, if the piston displacement does not exceed the first limiting value, then a second amount of fuel gas is injected into the pre-chamber, and, if the piston displacement exceeds the first limiting value, then less than the second amount of fuel gas is injected into the pre-chamber.

4. The method according to claim 1, comprising controlling an amount of firing energy with which the fuel-operated firing device is operated as a function of the piston displacement, wherein, if the piston displacement does not exceed a second limiting value greater than the first limiting value, then the fuel-operated firing device is operated with a regular amount of firing energy, and, if the piston displacement exceeds the second limiting value, then the fuel-operated firing device is operated with less than the regular amount of firing energy.

5. The method according to claim 4, comprising injecting fuel gas into the pre-chamber if the piston displacement does not exceed the second limiting value, and injecting no fuel gas into the pre-chamber if the piston displacement exceeds the second limiting value.

6. A computer program product with a program code for carrying out the method according to claim 1.

7. The computer program product of claim 6 wherein the program is executable in a common controller of the fuel-operated firing device.

8. A method for operating a fuel-operated firing device for driving securing elements into a substrate, the device comprising at least one main combustion chamber for a fuel; a driving piston which can be driven out of the at least one main combustion chamber from a rear dead center position in a firing direction by expandable gases; a pre-chamber with which an ignition device is associated and in which a pressure acting on the at least one main combustion chamber can build up prior to a fuel/air mixture being ignited in the at least one main combustion chamber; and, a detection device associated with the driving piston; connected to an electronic feedback control device for control purposes, in order to detect a piston displacement between an actual initial position of the driving piston prior to a firing operation and the rear dead center position, the method comprising controlling a quantity of fuel gas for injection into the pre-chamber and/or into the at least one main combustion chamber as a function of the piston displacement, wherein, if the piston displacement does not exceed a first limiting value, then a first amount of fuel gas is injected into the pre-chamber, and, if the piston displacement exceeds the first limiting value, then less than the first amount of fuel gas is injected into the pre-chamber.

9. The method according to claim 8, comprising controlling an amount of firing energy with which the fuel-operated firing device is operated as a function of the piston displacement, wherein, if the piston displacement does not exceed a second limiting value greater than the first limiting value, then the fuel-operated firing device is operated with a regular amount of firing energy, and, if the piston displacement exceeds the second limiting value, then the fuel-operated firing device is operated with less than the regular amount of firing energy.

10. The method according to claim 9, comprising injecting fuel gas into the at least one main chamber if the piston displacement does not exceed the second limiting value, and injecting no fuel gas into the at least one main chamber if the piston displacement exceeds the second limiting value.

11. A method for operating a fuel-operated firing device for driving securing elements into a substrate, the device comprising at least one main combustion chamber for a fuel; a driving piston which can be driven out of the at least one main combustion chamber from a rear dead center position in a firing direction by expandable gases; a pre-chamber with which an ignition device is associated and in which a pressure acting on the at least one main combustion chamber can build up prior to a fuel/air mixture being ignited in the at least one main combustion chamber; and, a detection device associated with the driving piston; connected to an electronic feedback control device for control purposes, in order to detect a piston displacement between an actual initial position of the driving piston prior to a firing operation and the rear dead center position, the method comprising controlling an amount of firing energy with which the fuel-operated firing device is operated as a function of the piston displacement, wherein, if the piston displacement does not exceed a first limiting value, then the fuel-operated firing device is operated with a regular amount of firing energy, and, if the piston displacement exceeds the first limiting value, then the fuel-operated firing device is operated with less than the regular amount of firing energy.

12. The method according to claim 11, comprising injecting fuel gas into only the at least one main combustion chamber and igniting the fuel gas if the piston displacement exceeds the first limiting value.

13. The method according to claim 11, comprising injecting fuel gas into only the pre-chamber and igniting the fuel gas if the piston displacement exceeds the first limiting value.

14. The method according to claim 11, comprising injecting fuel gas into the pre-chamber if the piston displacement does not exceed the first limiting value, and injecting no fuel gas into the pre-chamber if the piston displacement exceeds the first limiting value.

15. The method according to claim 11, comprising injecting fuel gas into the at least one main chamber if the piston displacement does not exceed the first limiting value, and injecting no fuel gas into the at least one main chamber if the piston displacement exceeds the first limiting value.

* * * * *